US007311265B2

(12) United States Patent
Bhatia

(10) Patent No.: US 7,311,265 B2
(45) Date of Patent: Dec. 25, 2007

(54) HAND-HELD SPRAYING APPARATUS HAVING A MULTI-COMPARTMENT LIQUID-HOLDING RESERVOIR

(75) Inventor: Kamlesh Kumar Bhatia, Wilmington, DE (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 132 days.

(21) Appl. No.: 10/900,340

(22) Filed: Jul. 27, 2004

(65) Prior Publication Data

US 2006/0022067 A1 Feb. 2, 2006

(51) Int. Cl.
*A62C 5/02* (2006.01)

(52) U.S. Cl. ..... 239/8; 239/303; 239/304; 239/320; 239/414; 222/140; 222/370; 222/410; 366/168.2; 366/280

(58) Field of Classification Search ..... 239/302, 239/303, 320, 414, 656, 667, 682; 222/370, 222/135, 145.6, 145.8, 138–142
See application file for complete search history.

(56) References Cited

U.S. PATENT DOCUMENTS

| | | | | |
|---|---|---|---|---|
| 1,061,062 | A * | 5/1913 | Freeland | 222/205 |
| 2,079,061 | A * | 5/1937 | Zuckerman | 239/656 |
| 3,091,402 | A * | 5/1963 | Palmer | 239/315 |
| 3,097,764 | A * | 7/1963 | Loeser | 222/55 |
| 4,496,081 | A * | 1/1985 | Farrey | 222/135 |
| 4,854,482 | A * | 8/1989 | Bergner | 222/94 |
| 5,899,362 | A | 5/1999 | Moran | |
| 6,187,711 | B1 | 2/2001 | Bernard et al. | |

FOREIGN PATENT DOCUMENTS

| | | | |
|---|---|---|---|
| WO | WO 00/55263 | A1 | 9/2000 |
| WO | WO 00/68331 | A1 | 11/2000 |

OTHER PUBLICATIONS

W. Clark Still, Stannylation/Destannylation. Preparation of a-Alkoxy Organolithium Reagents and Synthesis of Dendrolasin via a Carbinyl Carbanion Equivalent, American Chemical Society, 1978, pp. 1481-1486, 100, U.S.A.

Masanori Kosugi, Hiroyuki Naka, Hiroshi Sano, and Toshihiko Migita, Preparation and Some Properties of Acyltin Compounds, NOTES Bull. Chem. Soc. Japan, 1987, pp. 3462-3464, 60 No. 9, Japan.

(Continued)

*Primary Examiner*—Dinh Q. Nguyen

(57) ABSTRACT

A liquid reservoir of a hand-held, air-assisted spray apparatus is characterized by a plurality (i.e., two or more) of liquid-holding compartments. Each liquid-holding compartment is connected through an outlet port into fluid communication with the flow channel of the hand-held spraying apparatus.

The liquid-holding compartments are isolated from fluid communication with each other such that a liquid introduced into one of the compartments is held apart from a liquid introduced into the other compartment.

A rotatable element is associated with each liquid-holding compartment. Each rotatable element has a predetermined displacement. The rotatable elements are coupled together for rotation by a common shaft, so that, in use, the relative volumes of liquids dispensed from the respective liquid-holding compartments into the flow channel remain in a predetermined ratio regardless of the rate at which the liquids flow from their respective compartments. The component formulations of a multi-component coating such as that based on hydroxyl/isocyanate chemistry for automotive clearcoats are kept isolated until the actual time of application.

19 Claims, 1 Drawing Sheet

OTHER PUBLICATIONS

Bernard Jousseaume, Nicolas Noiret, Michel Pereyre, and Annie Saux, Air Activated Organotin Catalysts for Silicone Curing and Polyurethane Preparation, Organometallics, 1994, pp. 1034-1038, 13, No. 3, American Chemical Society, U.S.A.

Rama K. Bhatt, Jianhua Ye, and J.R. Falck, Convenient Preparation of a-Trimethylsilyloxy- and a-Hydroxystannanes from Aldehydes, Tetrahedron Letters, 1994, pp. 4081-4084, 35, No. 24, Elsevier Science Ltd., Great Britain.

A. Clark,I. Coldham,G.T. Crisp,C. Diaper,P.A.C. Eagle,P.J. Guiry,B. Jousseaume,R. Marshall,P. McCormack,M.G. Moloney,R. Okazaki,K. Oshima,J. Podlech,A.C. Spivey, N. Takeda,E.J. Thomas,P. Thornton,N. Tokitob,G.P. Vennall, M. Wood.P.B. Wyatt, D. Young, Science of Synthesis, Houben-Weyl Methods of Molecular Transformation, Organometallics, 2003, pp. 422-432, 5, Georg Thieme Verlag, Stuttgart-New York.

* cited by examiner

HAND-HELD SPRAYING APPARATUS HAVING A MULTI-COMPARTMENT LIQUID-HOLDING RESERVOIR

FIELD OF THE INVENTION

The present invention is directed to a hand-held spraying apparatus, and in particular, to a hand-held spraying having a multi-compartment liquid-holding reservoir.

DESCRIPTION OF THE PRIOR ART

Automobile refinish clearcoats typically comprise a three-dimensional cross-linked polymer formed by two major reactive components. One component comprises polyol oligimers with multiple hydroxl end groups. The other component comprises organic molecules having isocyanate functional groups, such as a trimer of hexamethylene di-isocyanate. This hydroxyl-isocyanate chemistry is also employed for certain primers as well as for monocoats.

These two components are generally packaged as separate formulations in a volatile solvent, such as ethyl acetate, and are sold in separate containers.

At least one of the component formulations, usually the one having the hydroxyl oligomers, also contains a polymerization catalyst, such as dibutyl tin di-laurate, DBTDL. The catalyst promotes the rate of polymerization when the two components are mixed. The volatile solvent reduces viscosity for effective spraying. The formulations may also include relatively minor amounts of additives such as viscosity modifiers and/or retarders of catalytic activity.

In the spraying technology practiced currently in refinish shops, the two component formulations are mixed prior to spraying and placed in a cup-like reservoir that is attached to a hand-held spraying apparatus. Due to the presence of catalyst, polymerization begins at an accelerated rate as soon as the component formulations are mixed. Thus, the viscosity of the mixture increases both before and while it is being sprayed.

The time it takes for the viscosity to increase to a point where spraying becomes ineffective, generally a two-fold increase in about thirty (30) minutes, is termed "pot life". There is available only a relatively short time window before the mixture becomes unusable. The possibility that the spray gun itself may become clogged with cured material is also disadvantageous.

One way to extend "pot life" is to add a greater amount of thinning solvent to the mixture. However, thinning agents contribute to increased emissions of volatile organic compounds and also increase the curing time. Thus, this alternative is not particularly attractive.

Other prior art attempts to extend "pot life" of the coating formulation have focused on "chemical-based" solutions.

For example, it has been suggested to include in the component formulation(s) certain additives that would retard polymerization in the mixing pot. However, the additives must be such that the rate of curing is not adversely affected after the coating is applied to the surface.

These chemical-based solutions may increase "pot life" to some degree. For example, clearcoats sold by E. I. du Pont de Nemours and Company have a "pot life" of about one (1) to two (2) hours. Another suggested alternative is to include relatively inactive catalysts, which becomes active form upon exposure to air after atomization.

Accordingly, in view of the foregoing it is believed advantageous to extend "pot life" of the coating formulation [on the order of four (4) to seven (7) hours] in a way that does not increase volatile organics in the formulation and does not delay the curing of the applied coating.

SUMMARY OF THE INVENTION

The present invention is directed to an apparatus and a method that implements a "mechanical" solution to extend the "pot life" of a coating formulation. In accordance with the present invention the structure of the liquid reservoir of a hand-held spray apparatus is modified to include a plurality (i.e., two or more) of liquid-holding compartments. Each liquid-holding compartment is connected through an outlet port into fluid communication with the flow channel of the hand-held spraying apparatus.

The liquid-holding compartments are isolated from fluid communication with each other such that a liquid introduced into one of the compartments is held apart from a liquid introduced into the other compartment.

A rotatable element is respectively associated with each liquid-holding compartment. Each rotatable element is sized to have a displacement such that, upon a full rotation thereof, a predetermined volume of liquid is dispensed through the outlet port from its associated liquid-holding compartment. The first and a second rotatable elements are coupled together for rotation, as by a common shaft, so that, in use, the relative volumes of liquids dispensed from the respective liquid-holding compartments into the flow channel remain in a predetermined ratio regardless of the rate at which the liquids flow from their respective compartments. In this way reactive components of a multi-component coating are kept isolated until the actual time of application, thereby avoiding any issue of "pot life" of a mixture of the components.

BRIEF DESCRIPTION OF THE DRAWINGS

The invention will be more fully understood from the following detailed description taken in connection with the accompanying drawings, which form a part of this application and in which.

DETAILED DESCRIPTION OF THE INVENTION

Figure 2:
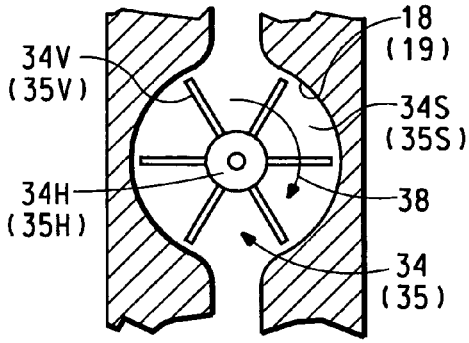
FIG. 2 is a stylized side elevational view, in section, taken along section lines 2-2 in FIG. 1, illustrating the general form of a dispensing element used in the reservoir attachment in accordance with the present invention.

Throughout the following detailed description similar reference numerals refer to similar elements in all figures of the drawings.

Figure 1:
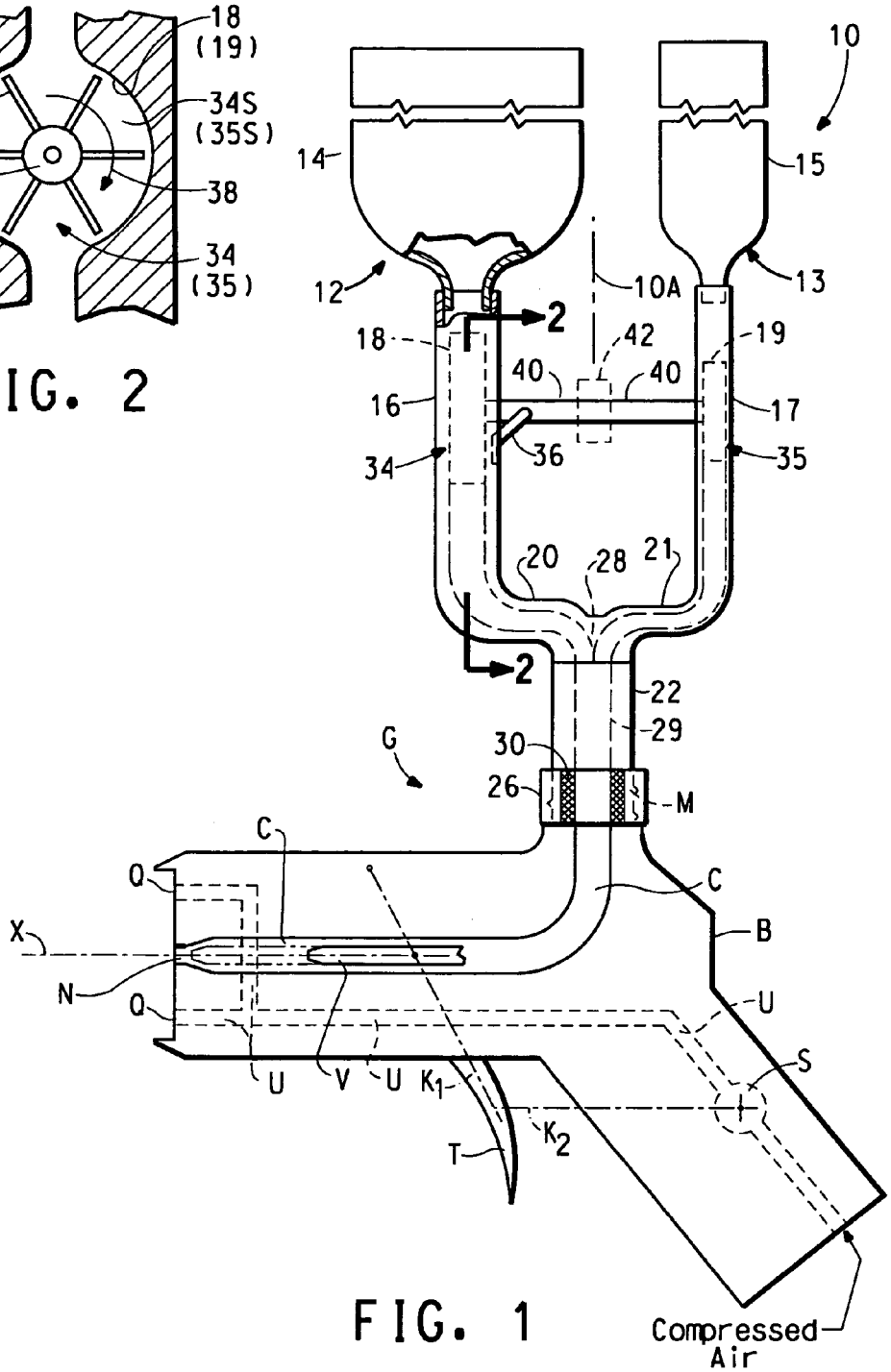
FIG. 1 is a stylized side elevational view, in section, showing a hand-held spraying apparatus having a multi-compartment liquid-holding reservoir attachment in accordance with the present invention.

Shown in FIG. 1 is a highly stylized diagrammatic illustration of a hand-held spraying apparatus, or spray gun, G for applying to a surface a multi-component liquid coating formulation. In the preferred usage the coating formulation is the type that requires that at least a first and a second component formulation be combined with a liquid polymerization catalyst solution.

The spray gun G is provided with a multi-compartment reservoir assembly generally indicated by the reference character 10 to be described more fully herein. As described herein the reservoir assembly 10 is provided in the form of an attachment that may be removably mounted to a conventional spray gun. Alternatively, it should be understood that a reservoir assembly 10 in accordance with the present invention may be formed integrally with spray gun G.

The conventional elements of the spray gun G are indicated herein by alphabetic reference characters. Spray guns of the type to be described are available from various manufacturers, including DeVilbiss Air Power Company, Jackson, Tenn.

The spray gun G includes a housing, or body, B through which extends a flow channel C. The outlet end of the channel C defines a flow nozzle N, typically sized in the range from about 0.8 to about 2.0 millimeters. The nozzle N is closed by movable needle valve V. Air ducts U extend through the housing B and terminate in atomizing openings Q located adjacent the nozzle N. A flow valve S is operative to control the passage of motive fluid through the ducts U. A trigger T is operatively linked, as diagrammatically suggested by the reference characters $K_1$, $K_2$, to control the actuation of both the needle valve nozzle N and the flow valve S.

For clarity of illustration the liquid-holding reservoir assembly 10 is shown in FIG. 1 as mounted with its the central axis 10A perpendicular with respect to the axis X of the flow channel C. However, for considerations of convenience and ease of use it should be understood that the reservoir assembly 10 may be mounted such that the central axis CL of the reservoir suitably inclines with respect to the axis X through the flow channel C for.

The liquid-holding reservoir assembly 10 structurally defines at least a first liquid-holding compartment 12 and a second liquid-holding compartment 13. Additional compartments may be provided within the reservoir assembly 10, as needed. The respective upper portion 14, 15 of each compartment 12, 13 is generally cup-like in form and is generally cylindrical in shape over substantially the major portion of its height. It should be understood, however, that the upper portion 14, 15 of each compartment 12, 13 may be formed into any convenient shape.

The upper portion 14, 15 of each of the compartments 12, 13 may be sized to accommodate any predetermined volume of liquid. However, in the preferred case the upper portions 14, 15 are sized such that when both of the compartments are filled to their respective fill marks the volume held within the respective upper portions 14, 15 are in the ratio in which the two liquids are desired to be mixed. For a two-component hydroxyl/isocyanate coating used in auto refinish applications the ratio is generally from about 3:1 to about 4:1.

The cross section of each of the upper portions 14, 15 is selected such that when the portions are filled to their respective fill marks the liquids are in hydraulic equilibrium, taking into account the density differences of the two liquids. That is, the product of the liquid height (from a common level) multiplied by the liquid density for each of the two liquids is the same. This minimizes any chance of intermixing of the two liquids when the gun is not in use.

It should also be appreciated that although the compartments 12, 13 are illustrated in FIG. 1 are configured to be physically spaced apart, other arrangements may used consistent with considerations of aesthetics or ease of construction. For example, the compartments may be attached one next to the other in abutting contact. Alternatively, a single large container may be subdivided, as by a partition, to define the separate compartments.

The upper portion of each compartment 12, 13 constricts into a lower neck portion 16, 17. The neck portion 16, 17 of each respective compartment 12, 13 has an internal dispensing cavity 18, 19 defined therein. The respective outlets 20, 21 from each of the compartments 12, 13 join at a junction 28 immediately upstream of a cylindrical mounting fitting 22.

The mounting fitting 22 has a collar 26 that threads onto the mounting receptacle M to mount the reservoir attachment 10 to the spray gun G. An internal flow passage 29 formed through the fitting 22 and the collar 26 communicates with the upper end of the flow channel C within the housing B. If desired a static mixing element 30 may be disposed within the mounting receptacle M (as is illustrated) or within the mounting fitting 22. In those instances where the spray gun G includes a sieve or a filter element, that element may also serve to provide a mixing function to some degree.

In a modified embodiment of the invention each upper portion 14, 15 may be made removably connectable with its respective associated neck portion 16, 17. In this way compartments 12, 13 with various sizes may be interchangeably mounted into the reservoir assembly 10. In the arrangement illustrated the lower end of each upper portion 14, 15 is telescopically received within the upper end of its respective neck portion 16, 17. Alternatively, the upper portions 14, 15 may be threadedly connected to the respective neck portions 16, 17.

The flow path for liquid introduced into either compartment 12, 13 extends from the upper portion 14, 15, through the respective dispensing cavity 18, 19 and associated outlets 20, 21, into the flow passages 28, and thence to the flow channel C.

A first dispensing element 34 and a second dispensing element 35 is associated with a respective liquid-holding compartment 12, 13. The dispensing elements 34, 35 are disposed within the respective dispensing cavity 18, 19 communicating with each compartment 12, 13.

The dispensing elements 34 and 35 are connected by a common shaft 40. If desired the shaft 40 may be interrupted by a speed reducing mechanism, suggested by the reference character 42 in FIG. 1, for a purpose to be described.

The dispensing elements 34, 35 may be implemented using any form of rotary displacement device that may be easily coupled together for rotation. A convenient structure for the dispensing elements is illustrated in FIG. 2. It should be understood that FIG. 2 illustrates the dispensing element 34. However, since dispensing element 35 is constructed in a corresponding manner reference characters denoting corresponding features for the dispensing element 35 are parenthetically indicated.

As shown in FIG. 2 the dispensing element 34 (35) has a central hub 34H (35H) to which are attached radially outwardly extending vanes 34V (35V). The vanes 34V (35V) may be configured in any convenient manner. They may be straight (as illustrated) or curved, flexible, or exhibit an extended tip area, all as appreciated by those skilled in the art.

The vanes 34V (35V) terminate within a close clearance (exaggerated for clarity) of the walls defining the cavity 18 (19). The clearance is appropriately selected to allow the dispensing element 34 (35) to rotate freely rotatable within the cavity (e.g., the direction of the arrow 38) without requiring an appreciable liquid head thereabove, while at the same time preventing appreciable leakage.

For greater precision the clearance may be kept quite tight or the vanes may be designed to be in wiping contact with the walls of the cavity and the rotatable elements may be rotated with the assistance of an air motor attached to the shaft 40. The air motor may be conveniently powered by all or part of the air used by the spray gun G.

This may be accomplished in any of several ways. A convenient way is to direct a small portion of the air downstream of the valve S to the air motor. The flow of air directed to the motor is maintained in a fixed proportion to that going to the air ducts U by inserting an appropriately sized orifice in the flow channel to the motor. Thereby, the speed of rotation of the rotary elements (i.e., the rate of liquid dispensed) is maintained in the desired proportion to the air used in assisting atomization.

Each dispensing element 34 (35) has a predetermined liquid displacement. By "displacement" is meant the volume of liquid displaced (dispensed) upon one full rotation of the element 34 (35). Thus, upon a full rotation of a given dispensing element 34 (35) a predetermined volume of liquid is able to be dispensed through the outlet port 18, 19 of the respective associated liquid-holding compartment 12, 13.

A latch member 36 is mounted to the shaft 40. When asserted, the latch member 36 prevents rotation of the shaft 40 and, thus, rotation of the rotatable dispensing elements 34, 35 connected thereto. It is preferred that the latch 36 is in the asserted position when the gun G is not in use. The latch 36 is also helpful in filling the reservoir assembly 10, as will be developed.

—o-0-o—

The theory and operation of air-assisted spray guns are explained in Lefebvre, *Atomization and Sprays,* Hemisphere Publications, New York, 1989.

A hand-held spray gun G having a multi-compartment holding reservoir attachment 10 is especially useful in auto body repair shops for applying a bi-component coating comprising hydroxyl-end group and isocyanate moieties, such as a cross-linked clearcoat, to a surface. As noted earlier it is the prior practice to pre-mix the component formulation containing the hydroxyl-end groups with the component formulation containing the isocyanate groups (also known as the "activator") and to charge that mixture into the reservoir of a prior art spray gun. Since at least one of the component formulations includes a catalyst (also known as the "accelerator"), a polymerization reaction at an accelerated is initiated the moment the two components mix together. This reaction continues within the reservoir with the deleterious consequences outlined above.

In typical use of the present invention, with the nozzle N closed by the valve V and with the latch 44 asserted, one of the component formulations of the coating is charged into a respective one of the compartments of the reservoir assembly 10. Preferably, the larger volume component of the combination is charged first. For a hydroxyl/isocyanate coating, the component formulation containing the hydroxyl-end group is first charged into the larger compartment 12. With the latch 44 asserted the elements 34 cannot rotate and the liquid formulation cannot run into the flow channel C (except for a small amount of leakage) and backfill into the compartment 13.

The component formulation containing the isocyanate group is charged into the smaller compartment 13. One or both of these formulations may contain the catalyst solution. Since the compartments 12, 13 are isolated from each other, the component formulations cannot react and polymerization is not initiated. Thus, the component formulations may be held in their respective compartments 12, 13 for an extended period. Any small amounts of isocyanate formulation from the compartments 12, 13 that may leak past the rotatable elements 34, 35 and into the flow channel C and react are cleared within the first few seconds of adjustment of the spray.

The spray gun G is connected to a source of pressurized motive fluid, such as compressed air, through a suitable connection. Prior to operation the latch 44 is retracted. Actuation of the trigger T substantially simultaneously withdraws the needle valve V from the nozzle outlet N of the flow channel C (over the linkage $K_1$) and opens the valve S (over the linkage $K_2$). Opening of the flow valve S permits motive air to flow at high velocity through the atomizing openings Q and assists in atomizing the liquid flowing through the nozzle N into a fine spray and propelling the liquid in the flow channel toward the surface to be coated.

Simultaneously, opening of the valve V permits liquid to flow by gravity from the compartments 12, 13, rotating the rotatable dispensing elements 34, 35. Due to the relative displacements of the dispensing elements 34, 35 the relative amounts of liquids dispensed from the respective liquid-holding compartments into the flow channel are in a predetermined ratio regardless of the rate at which the liquids flow from their respective liquid-holding compartments.

By varying the relative displacements of the dispensing elements 34, 35 the relative volumes of liquid able to be dispensed from the respective liquid-holding compartments 12, 13 is varied. If the fluid holding capacity of each dispensing elements 34, 35 is the same equal volumes of liquid are able to be dispensed. Alternatively, if the fluid holding capacity of the elements 34, 35 is different, different relative volumes of liquids are able to be dispensed upon each full rotation of the dispensing elements. By appropriate sizing of the displacement of each dispensing elements 34, 35 (as by adjusting the radial dimension and/or the width dimension of the vanes) any desired ratio of the liquid components may be dispensed.

It is to be noted that no matter how they are sized since the first and a second rotatable elements are coupled together for rotation the relative volumes of liquid dispensed from the respective liquid-holding compartments into the flow channel are in a predetermined desired ratio. This ratio is maintained regardless of the rate at which the liquids are drawn from their respective liquid-holding compartments.

As noted earlier, in accordance with an alternative embodiment of the present invention the dispensing elements 34, 35 are connected through a speed reducing mechanism 42 (FIG. 1). In this instance the rotational speeds of the dispensing elements differ.

It should be appreciated that although the operation of the reservoir assembly of the present invention has described in the context of a gravity-feed, hand-held, air-assisted spray apparatus, it is equally applicable to a suction feed arrangement.

As described above, the reservoir assembly 10 in accordance with the present invention is seen as providing significant advantages over the prior art spray apparatus. Since the reactive component formulations are kept separated in respective compartments, these components may be formulated for optimal results (in terms of curing time or coating properties, for example) independently of "pot life" considerations. Also, since "pot life" is not a consideration, the amount of solvents usage may be greatly reduced, thus significantly reducing emission of volatile organic compounds.

Those skilled in the art, having the benefit of the teachings of the present invention as hereinabove set forth, may effect numerous modifications thereto. Such modifications are to be construed as lying within the contemplation of the present invention, as defined by the appended claims.

What is claimed is:

1. A hand-held, air-assisted spraying apparatus for applying a liquid coating formulation of the type that requires at least a first and a second component be combined to produce a coating on a surface, at least one of the components including a catalyst therein, the spraying apparatus comprising:

a spray housing having a flow channel extending therethrough;

a reservoir assembly mounted to the spray housing, the reservoir assembly having at least a first and a second liquid-holding compartment, each liquid-holding compartment being connected through an outlet port into fluid communication with the flow channel, each liquid-holding compartment being isolated from fluid communication with the other liquid-holding compartment, a first and a second rotatable element respectively disposed in fluid communication with each liquid-holding compartment, each rotatable element having a predetermined displacement such that, upon a full rotation thereof, predetermined equal volumes of liquid are dispensed through the outlet port from its associated liquid-holding compartment, wherein the first and the second rotatable elements are mechanically connected through a speed-reducing arrangement so that the rotatable elements rotate at different rotational speeds, such that in use, the relative amounts of liquids dispensed from the respective liquid-holding compartments into the flow channel are in a predetermined ratio regardless of the rate at which the liquids flow from their respective liquid-holding compartments.

2. The spraying apparatus of claim 1 further comprising a static mixer disposed between the first and a second rotatable elements and the flow channel.

3. The spraying apparatus of claim 1 wherein each compartment comprises an upper cup portion and a lower neck portion, the upper cup portion of each compartment being removably connected to its associated neck portion.

4. A hand-held air-assisted the spraying apparatus for applying a liquid coating formulation of the type that requires at least a first and a second component be combined to produce a coating on a surface, at least one of the components including a catalyst therein, the spraying apparatus comprising a spray housing having a flow channel extending therethrough;

a reservoir assembly mounted to the spray housing, the reservoir assembly having at least a first and a second liquid-holding compartment, each liquid-holding compartment being connected through an outlet port into fluid communication with the flow channel, each liquid-holding compartment being isolated from fluid communication with the other liquid-holding compartment, a first and a second rotatable element respectively associated of each liquid-holding compartment, each rotatable element having a predetermined displacement such that upon a full rotation thereof, a predetermined different volumes of liquid are dispensed through the outlet port from its associated liquid-holding compartment, the first and a second rotatable elements being coupled together by a common shaft for rotation at the same rotational speed such that, in use, the relative amounts of liquids dispensed from the respective liquid-holding compartments into the flow channel are in a predetermined ratio regardless of the rate at which the liquids flow from their respective liquid-holding compartments, and, a latch member which, when asserted, prevents rotation of the common shaft to which each of the rotatable element is connected.

5. The spraying apparatus of claim 4 further comprising a static mixer disposed between the first and the second rotatable elements and the flow channel.

6. The spraying apparatus of claim 4 wherein each compartment comprises an upper cup portion and a lower neck portion, the upper cup portion of each compartment being removably connected to its associated neck portion.

7. A reservoir assembly attachment for a hand-held, air-assisted spraying apparatus of the type having a spray housing having a flow channel extending therethrough, the attachment being removably connectable to the spray housing, the attachment comprising:

a first and a second liquid-holding compartment, each liquid-holding compartment being connected through an outlet port into fluid communication with the flow channel, each liquid-holding compartment being isolated from fluid communication with the other liquid-holding compartment, a first and a second rotatable element respectively disposed in fluid communication with each liquid-holding compartment, each rotatable element having a predetermined displacement such that, upon a full rotation thereof, predetermined equal volumes of liquid are dispensed through the outlet port from its associated liquid-holding compartment, wherein the first and the second rotatable elements are mechanically connected through a speed-reducing arrangement so that the rotatable elements rotate at different rotational speeds, such that, in use, the relative amounts of liquids dispensed from the respective liquid-holding compartments into the flow channel are in a predetermined ratio regardless of the rate at which the liquids flow from their respective liquid-holding compartments.

8. The reservoir assembly attachment of claim 7 further comprising a static mixer disposed between the first and a second rotatable elements and the flow channel.

9. The reservoir assembly attachment of claim 7 wherein each compartment comprises an upper cup portion and a lower neck portion, the upper cup portion of each compartment being removably connected to its associated neck portion.

10. A reservoir assembly attachment for a hand-held, air-assisted spraying apparatus of the type having a spray housing having a flow channel extending therethrough, the attachment being removably connectable to the spray housing, the attachment comprising a spray housing having a flow channel extending therethrough;

a reservoir assembly mounted to the spray housing, the reservoir assembly having at least a first and a second liquid-holding compartment, each liquid-holding compartment being connected through an outlet port into fluid communication with the flow channel, each liquid-holding compartment being isolated from fluid communication with the other liquid-holding compartment, a first and a second rotatable element respectively associated of each liquid-holding compartment, each rotatable element having a predetermined displacement such that, upon a full rotation thereof, a predetermined different volumes of liquid are dispensed through the outlet port from its associated liquid-holding compartment, the first and a second rotatable elements being coupled together by a common shaft for rotation at the same rotational speed such that, in use, the relative amounts of liquids dispensed from the respective liquid-holding compartments into the flow channel are in a predetermined ratio regardless of the rate at which the liquids flow from their respective liquid-holding compartments and, a latch member which, when asserted, prevents rotation of the common shaft to which each of the rotatable element is connected.

11. The spraying apparatus of claim 10 further comprising a static mixer disposed between the first and the second rotatable elements and the flow channel.

12. The spraying apparatus of claim 10 wherein each compartment comprises an upper cup portion and a lower neck portion, the upper cup portion of each compartment being removably connected to its associated neck portion.

13. A method for applying a liquid coating formulation using a hand-held, air-assisted spray apparatus having a flow channel extending therethrough, the flow channel terminating in a nozzle, the liquid coating formulation being of the type that requires at least two reactive component formulations to be combined to produce a coating on a surface, the method comprising the steps of:

(a) with the nozzle closed, charging a first component formulation and a second component formulation into a respective first and second liquid-holding compartment, at least one of the component formulations having a predetermined amount of a catalyst solution therein, each liquid-holding compartment being connected through an outlet port into fluid communication with the flow channel, each liquid-holding compartment being isolated from fluid communication with the other liquid-holding compartment, each liquid-holding compartment having a rotatable dispensing element respectively associated therewith, the rotatable dispensing elements being coupled together for rotation one with the other, each rotatable dispensing element having a predetermined displacement such that, upon a full rotation thereof, a predetermined volume of liquid is dispensed from its associated liquid-holding compartment; and (b) passing air through the spray apparatus and simultaneously opening the nozzle thereby allowing liquid to flow from the compartments into the flow channel and rotating the rotatable dispensing elements, so that, in use, the relative amounts of liquids dispensed from the respective liquid-holding compartments into the flow channel are in a predetermined ratio regardless of the rate at which the liquids flow from their respective liquid-holding compartments.

14. The method of claim 13 wherein the coating formulation comprises polymerizable compounds.

15. The method of claim 14 wherein the coating formulation comprises polymerizable oligimers.

16. The method of claim 15 wherein the polymerizable oligimers comprise polyol oligimers with multiple hydroxl end groups.

17. The method of claim 14 wherein the coating formulation comprises polymerizable organic molecules having isocyanate functional groups.

18. The method of claim 17 wherein the polymerizable organic molecules are trimers of hexamethylene di-isocyanate.

19. The method of claim 13 wherein the polymerization catalyst solution includes dibutyl tin di-laurate.

* * * * *